US008517341B2

(12) United States Patent
Edwards

(10) Patent No.: US 8,517,341 B2
(45) Date of Patent: Aug. 27, 2013

(54) PRY BAR WITH SLIDING FULCRUM ASSEMBLY

(75) Inventor: Donald V. Edwards, Harrison City, PA (US)

(73) Assignee: Simtec, Co., Irwin, PA (US)

( * ) Notice: Subject to any disclaimer, the term of this patent is extended or adjusted under 35 U.S.C. 154(b) by 154 days.

(21) Appl. No.: 13/135,115

(22) Filed: Jun. 27, 2011

(65) Prior Publication Data

US 2012/0061631 A1 Mar. 15, 2012

Related U.S. Application Data

(63) Continuation-in-part of application No. 29/370,858, filed on Sep. 14, 2010, now Pat. No. Des. 642,041.

(51) Int. Cl.
*B66F 19/00* (2006.01)

(52) U.S. Cl.
USPC ..... 254/129; 254/21; 254/25

(58) Field of Classification Search
USPC ..... 254/129, 30, 131, 131.5, 25, 21
See application file for complete search history.

(56) References Cited

U.S. PATENT DOCUMENTS

| | | | | |
|---|---|---|---|---|
| 3,155,255 | A * | 11/1964 | Daniel | 414/444 |
| 3,157,411 | A * | 11/1964 | Rhodes | 280/47.29 |
| 3,467,405 | A * | 9/1969 | Fogg | 280/47.24 |
| 5,382,131 | A * | 1/1995 | Werthmann | 414/684.3 |
| 7,618,020 | B2 * | 11/2009 | Del Favero | 254/25 |
| 7,673,848 | B1 * | 3/2010 | Provines | 254/25 |
| 2006/0108570 | A1 * | 5/2006 | Del Favero | 254/131 |
| 2010/0044657 | A1 * | 2/2010 | Patrick et al. | 254/130 |
| 2012/0061631 | A1 * | 3/2012 | Edwards | 254/129 |

* cited by examiner

*Primary Examiner* — Lee D Wilson
(74) *Attorney, Agent, or Firm* — Carothers & Carothers

(57) ABSTRACT

A pry bar with a sliding fulcrum assembly wherein the sliding fulcrum has a body with a passage therethrough that is configured and contoured for the fulcrum body to normally freely slide along the elongated pry bar, when hanging on the pry bar. The bottom of the passage through the fulcrum body is provided with a bar friction engagement surface on a bottom portion of the passage whereby the fulcrum is non-slidably engaged with the pry bar when the bottom of the fulcrum body is engaged with the floor surface under applied lifting force of the lifting lip of the pry bar applied against an object to be lifted.

3 Claims, 5 Drawing Sheets

PRY BAR WITH SLIDING FULCRUM ASSEMBLY

CROSS REFERENCE

This application is a continuation-in-part of U.S. Design patent application No. 29/370,858, filed Sep. 14, 2010, now U.S. Pat. No. D,642,041 and entitled FURNITURE LIFT.

BACKGROUND OF THE INVENTION

The present invention relates generally to a lifting device and more particularly to a pry bar with a fulcrum assembly which is slidably mounted on the pry bar.

Pry bars are commonly used for lifting furniture in the moving industry and in the carpet cleaning industry in order to place a slide under the furniture so that it may be easily moved.

The pry bar of the present invention pertains to pry bars with an adjustable fulcrum which allows a user to obtain the optimum leverage when engaging the object to be lifted with the pry bar lifting end.

Presently there are two such known pry bar assemblies with an adjustable fulcrum member. One is illustrated in U.S. Pat. No. 7,618,020, which discloses an adjustable fulcrum for use with a conventional pry bar. The fulcrum member consists of a tubular body with opposed slots in the sidewall thereof to receive the pry bar. The fulcrum body is generally made of a plastic, such as HDPE. An existing problem incurred with the adjustable fulcrum member of this invention is that the pry bar can slide relative to the fulcrum member after the load is engaged with the pry bar, and the fulcrum position therefore cannot be reliably retained and the fulcrum position must be changed by direct hand manipulation of the fulcrum body.

A pry bar with a sliding fulcrum assembly is also illustrated in U.S. Pat. No. 7,673,848. A problem incurred with the slidably mounted fulcrum assembly disclosed in this patent is that the fulcrum assembly must be hand manipulated and engaged and disengaged. It does not freely slide along the pry bar and therefore is not capable of self-adjustment.

It is an object of the present invention to provide a slidable fulcrum assembly which freely floats along the upper surface of the pry bar for self-adjustment to provide maximum lifting efficiency, yet when lifting pressure is applied to the fulcrum assembly by the pry bar, the pry bar engages the fulcrum assembly to automatically prevent any further relative movement between the pry bar and the fulcrum assembly.

SUMMARY OF THE INVENTION

The combination pry bar and sliding fulcrum assembly of the present invention includes an elongated pry bar having a generally horizontally extending lifting arm with a lifting lip at its distal end for engaging an object to be lifted, and an upright elongated handle coupled to the proximal end of the lifting arm through a curvature. The sliding fulcrum assembly consists of a body with a passage through the body which is configured and contoured for the body to normally freely slide along the bar, including the curvature thereof, when the fulcrum body is hanging on the bar. The fulcrum assembly body has a bottom curvature for engaging a floor surface as a fulcrum. The axis of this bottom curvature extends transversely to the central axis of extension of the elongated pry bar to provide a rocking fulcrum contact surface.

The bottom of the passage through the fulcrum assembly is provided with a bar friction engagement surface on a bottom portion of the passage whereby the sliding fulcrum assembly body is non-slidably engaged with the pry bar when the bottom curvature of the body is engaged with a floor surface under applied lifting force of the lifting lip of the pry bar against an object to be lifted.

This bar friction engagement surface consists of a material of high coefficient of friction, such as TPE.

This friction engagement surface may also include a wedged shaped configuration whereby the friction engagement surface frictionally engages the bar with a wedging action in order to further enhance the gripping action between the pry bar and the fulcrum assembly.

The pry bar and the passage through the fulcrum assembly may have a corresponding non-round cross sectional configuration whereby the fulcrum body is prevented from rotating on the bar.

An advantage of the combination of the present invention is that the pry bar is provided with a free floating fulcrum assembly which self-adjusts on the pry bar when initially engaging the pry bar with an object to be lifted. It also permits the operator to be positioned closer to the object to be lifted thereby providing effective leverage and maneuverability in tight spaces, and once the lifting force is applied to the bar, there is assurance that the pry bar will not slip relative to the fulcrum assembly.

The combination pry bar and sliding fulcrum assembly of the present invention provides a free floating fulcrum assembly which will readily self-adjust and positively engage with the pry bar when lifting force is applied. It permits the operator to work closer to the object being lifted, and it also provides a safer lifting mechanism than a pry bar which is provided with a wheeled fulcrum.

BRIEF DESCRIPTION OF THE DRAWINGS

Other objects and advantages appear hereinafter in the following description and claims. The accompanying drawings show, for the purpose of exemplification, without limiting the scope of the invention or the appended claims, certain practical embodiments of the present invention wherein:

DETAILED DESCRIPTION OF A PREFERRED EMBODIMENT

Figure 1:
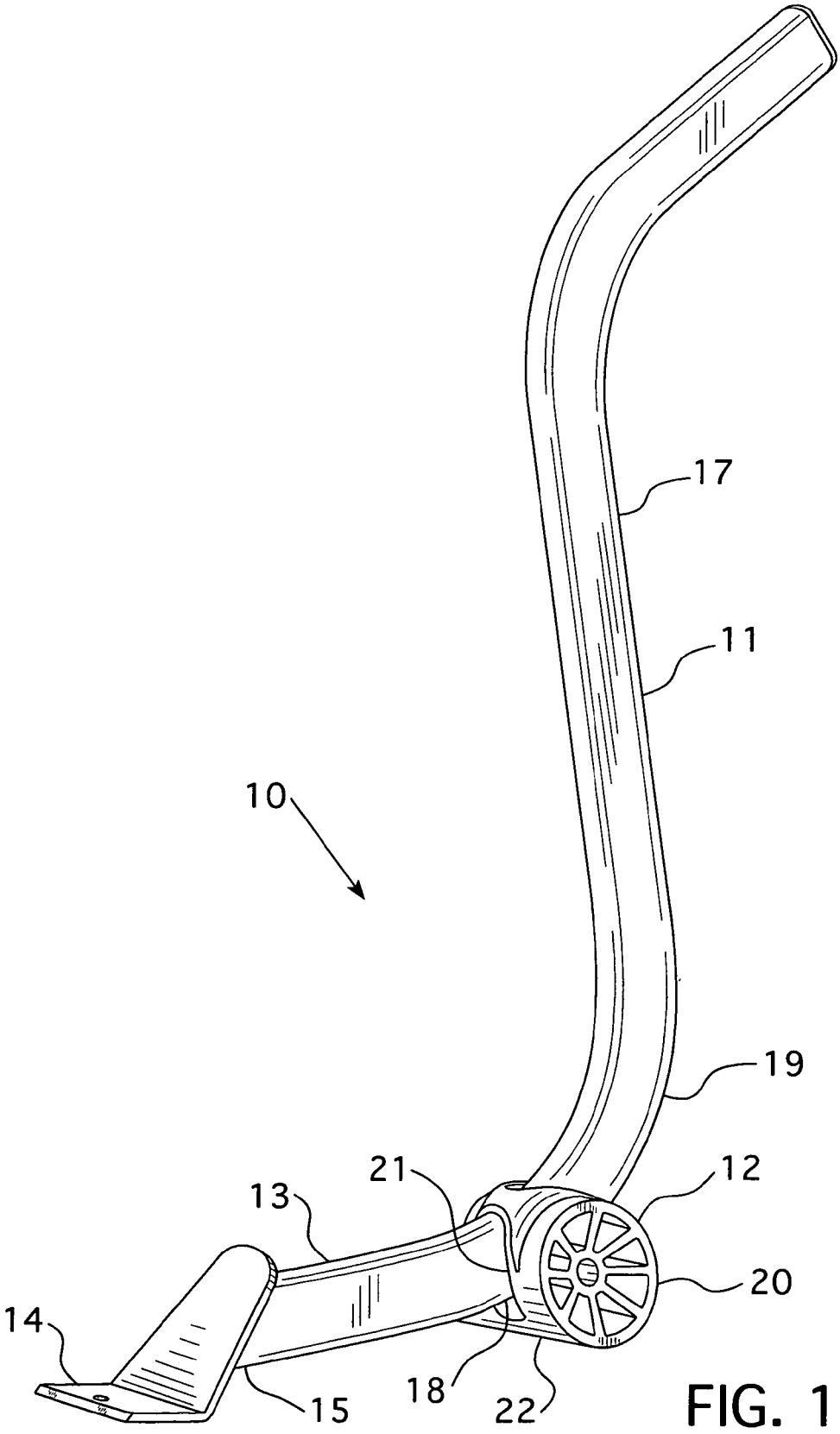
FIG. 1 is a left side perspective view of the combination pry bar with a sliding fulcrum assembly of the present invention.

Referring to the drawings, the combination 10 of the present invention is comprised of pry bar 11 with a sliding fulcrum assembly 12. The pry bar 11 has a generally horizontally extending lifting arm 13 with a lifting lip 14 at its distal end 15 for engaging an object 16*a* (FIG. 3) or 16*b* (FIG. 4) to be lifted, and an upright elongated handle 17 coupled to the proximal end 18 of lifting arm 13 through curvature 19.

Sliding fulcrum assembly 12 consists of body 20 having passage 21 therethrough which is configured and contoured for the body 20 to normally freely slide along bar 11, including curvature 19, when hanging on bar 11. Body 20 is provided with a bottom contact surface having a curvature 22 for engaging a floor surface 23 as a fulcrum for pry bar 11. The axis of this bottom curvature 22 extends transversely to the central axis of extension of elongated pry bar 11.

The bottom 24 of passage 21 is provided with a bar friction engagement surface 25 at the bottom portion thereof whereby the body 20 is non-slidably engaged with pry bar 11 when the bottom curvature 22 of the body is engaged with a floor surface 23 under applied lifting force of the lifting lip 14 against an object 16A or 16B to be lifted.

The body 22 may be molded of HPDE and the friction engagement surface 25 is an insert molded of a material with a high coefficient of friction, such as TPE.

Figure 5:
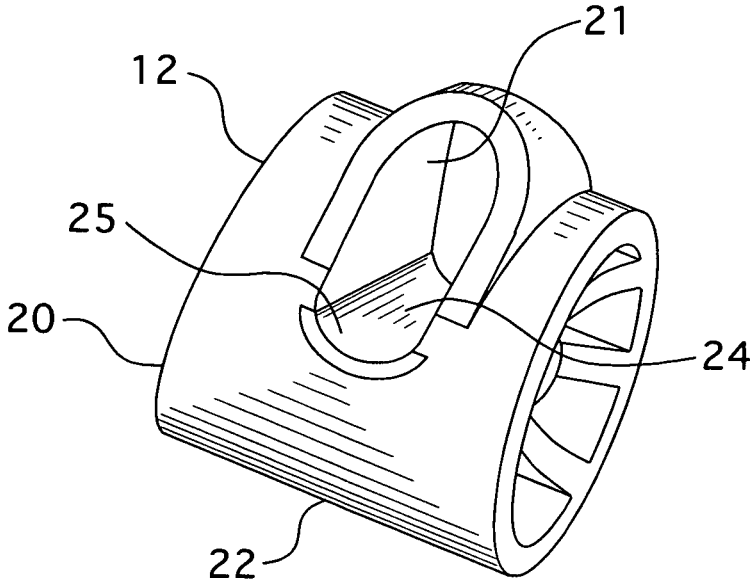
FIG. 5 is an enlarged perspective view of the sliding fulcrum assembly of the combination of the present invention shown independently of the pry bar.
Figure 6:
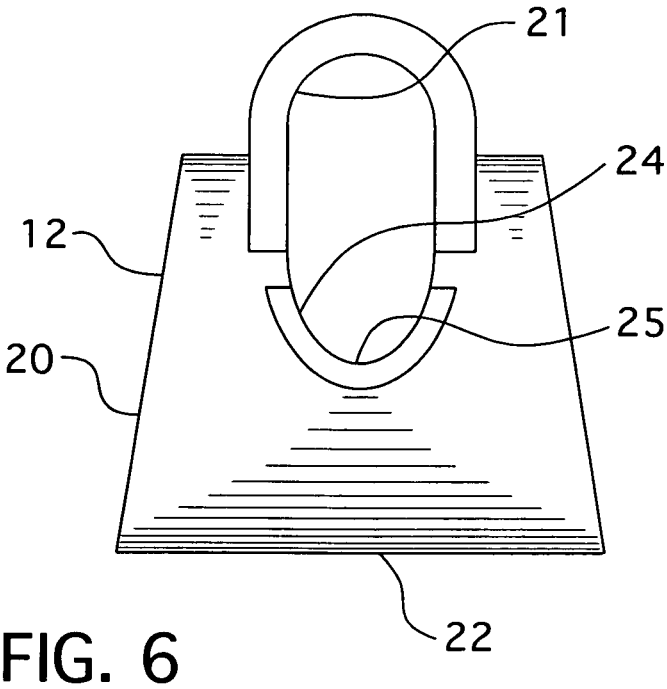
FIG. 6 is a view in front elevation of the sliding fulcrum assembly shown in FIG. 5 illustrating a variation in the configuration of the surface which frictionally engages the pry bar.

In the variation shown in FIG. 6, the friction engagement surface 25 is a wedged shape configuration as opposed to the more rounded surface as shown in FIG. 5, whereby the friction engagement surface 25 in FIG. 6 will frictionally engage the pry bar 11 with a wedging action to provide an even stronger non-slip grip.

The pry bar 11 and the corresponding passage 21 in body 22 have non-round cross sectional configurations, in this instance, a generally oval configuration. This prevents the body 22 from rotating on pry bar 11.

Figure 2:
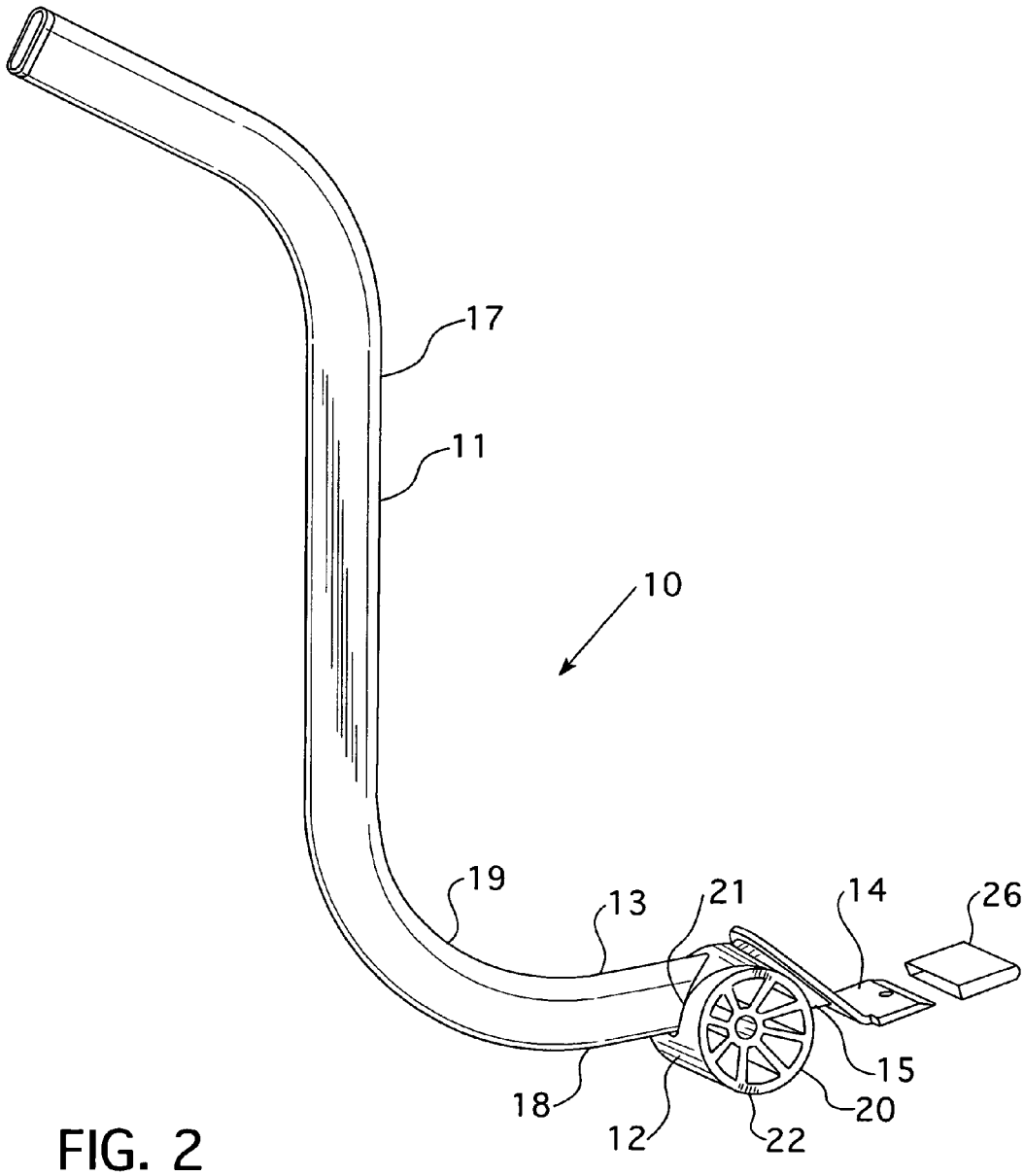
FIG. 2 is a right side exploded perspective view of the combination pry bar with a sliding fulcrum assembly shown in FIG. 1 with a protective cover illustrated in position for covering the lifting tongue of the pry bar.

As shown in FIG. 2, the protective cover 26 may be slid over tongue 14 in order to protect the furniture or other objects being lifted.

Figure 3:
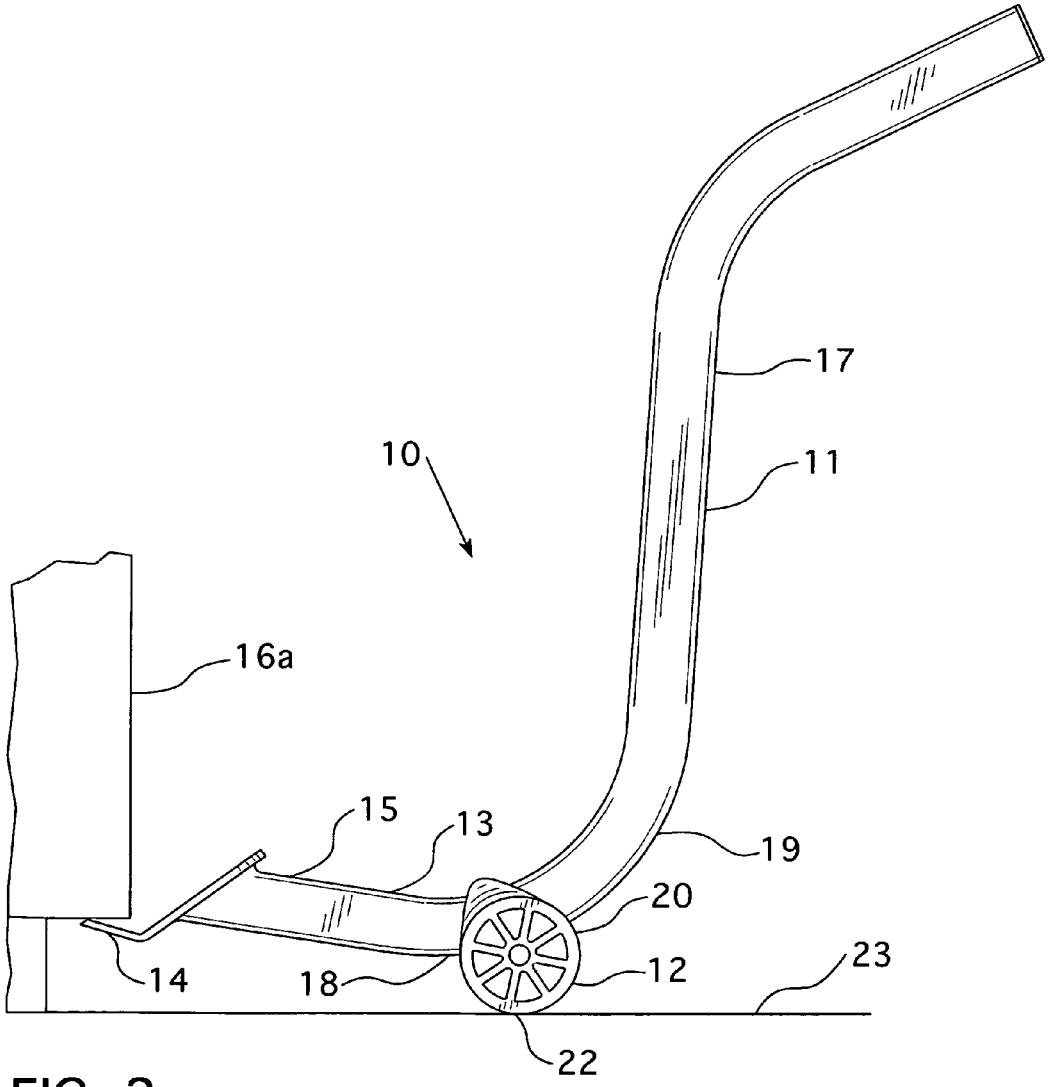
FIG. 3 is a left side view in elevation of the combination of FIG. 1 shown in initial engagement with an object to be lifted, the base of which object is spaced from the floor surface.
Figure 4:
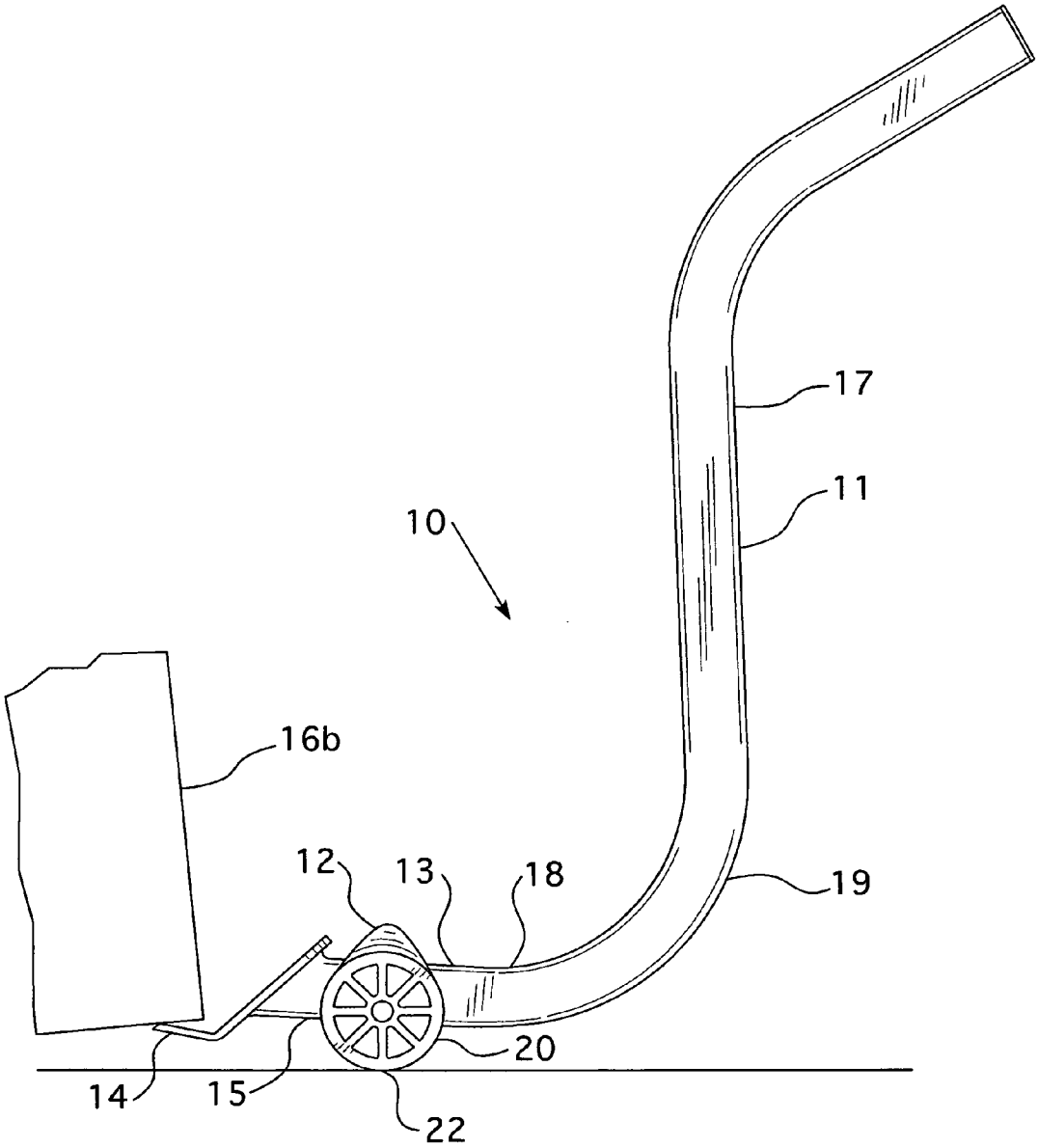
FIG. 4 is a view in left side elevation of the combination shown in FIG. 1 with the fulcrum assembly adjusted for lifting an object, the base of which initially was engaged with the floor surface.

FIGS. 3 and 4 illustrate the extreme limits of adjustability possible with the free floating fulcrum assembly 12. In FIG. 3 the base of object 16*a* to be lifted is spaced off of the floor surface 23 and therefore when approached with the combination 11 of the present invention to engage lifting lip 14 with the underside of object 16*a*, the fulcrum assembly 12 will self-adjust to the position illustrated in FIG. 3.

To the contrary, when the base of an object which normally rests on the floor surface 23 as object 16*b* in FIG. 4, the sliding fulcrum assembly will self-adjust to the position shown in FIG. 4 for initially engaging the lifting lip 14 under the object 16*b*.

I claim:

1. In combination, a pry bar with a sliding fulcrum assembly, the combination comprising:

said pry bar having a generally horizontally extending lifting arm with a lifting lip at the distal end of said lifting arm for engaging an object to be lifted, and an upright elongated handle coupled to the proximal end of the lifting arm through a curvature provided between said handle and said lifting lip;

said sliding fulcrum assembly having a body with a passage therethrough configured and contoured for said body to normally freely slide along said bar, including said curvature, when hanging on said bar, said body having a bottom contact surface for engaging a floor surface as a fulcrum;

the bottom of said passage having a bar friction engagement surface on a bottom portion thereof whereby said body is non-slidably engaged with said pry bar when said bottom contact surface is engaged with a floor surface under applied lifting force of said lifting lip against an object to be lifted.

2. The combination of claim 1, said friction engagement surface including a wedge shaped configuration whereby said surface frictionally engages said bar with a wedging action.

3. The combination of claim 1, wherein said pry bar and said passage having corresponding non-round cross sectional configurations whereby said body is prevented from rotating on said bar.

* * * * *